United States Patent [19]

Simpson et al.

[11] Patent Number: 4,720,939

[45] Date of Patent: Jan. 26, 1988

[54] WIDE BELT SANDER CLEANING DEVICE

[75] Inventors: Steven C. Simpson; Ronald D. Witt, both of Kansas City, Mo.; Gregory E. Volkland, Merriam, Kans.

[73] Assignee: Simpson Products, Inc., Lenexa, Kans.

[21] Appl. No.: 867,331

[22] Filed: May 23, 1986

[51] Int. Cl.[4] ..... B24B 53/10

[52] U.S. Cl. ..... 51/135 R; 51/262 A; 51/165.71

[58] Field of Search ..... 51/5 D, 135 R, 137, 51/138, 165.71, 165.87, 165.88, 165.9, 165.91, 99, 262 A, 325; 125/11 R

[56] References Cited

U.S. PATENT DOCUMENTS

| | | | |
|---|---|---|---|
| 2,015,603 | 9/1935 | Maris . | |
| 2,280,767 | 4/1942 | Ferragano . | |
| 2,442,088 | 5/1948 | Kreutzer | 125/11 R |
| 2,647,272 | 8/1953 | Holmes | 51/99 |
| 2,665,531 | 1/1954 | Swertsen | 51/262 A |
| 3,097,457 | 7/1963 | Seligman | 51/246 |
| 3,123,950 | 3/1964 | Kuris et al. | 51/262 A |
| 3,812,622 | 5/1974 | Parsons | 51/262 A |
| 4,182,082 | 1/1980 | Meyer | 125/11 R X |
| 4,293,970 | 10/1981 | Bencene et al. | 15/21 D |
| 4,356,671 | 11/1982 | Gabrielson et al. | 51/262 A |
| 4,438,601 | 3/1984 | Olson | 51/262 A |
| 4,483,103 | 11/1984 | Bickel | 51/165.87 |
| 4,525,955 | 7/1985 | Cothrell et al. | 51/262 A |
| 4,539,779 | 9/1985 | Donner | 51/165.88 |

*Primary Examiner*—Robert P. Olszewski

*Attorney, Agent, or Firm*—Litman, McMahon & Brown

[57] ABSTRACT

A device for cleaning abrasive surfaces used in wood sanding operations includes a frame attached to the frame of a belt sanding machine. A retainer assembly is carried by the frame and receives a block of natural or synthetic rubber cleaning material. The retainer assembly and associated block are selectively moved into position whereby abrasive contact of the block with a running belt for cleaning is achieved. The movement of the cartridge assembly is controlled by a fluid cylinder arrangement. Hydraulic withdrawal cylinders at either end of the frame are set to lift the cartridge assembly and block in an upward direction out of a contact position with the sanding belt. A central fluid projection cylinder is used to overcome the upward force of the two outer cylinders, for forcing the block into operative contact with the belt when desired. Controls are provided for regulating contact time with the belt depending on operating conditions. Alternative controls may also be used to adjust the pressure in the cylinders to compensate for the changing weight of the block as it is worn away during use.

11 Claims, 12 Drawing Figures

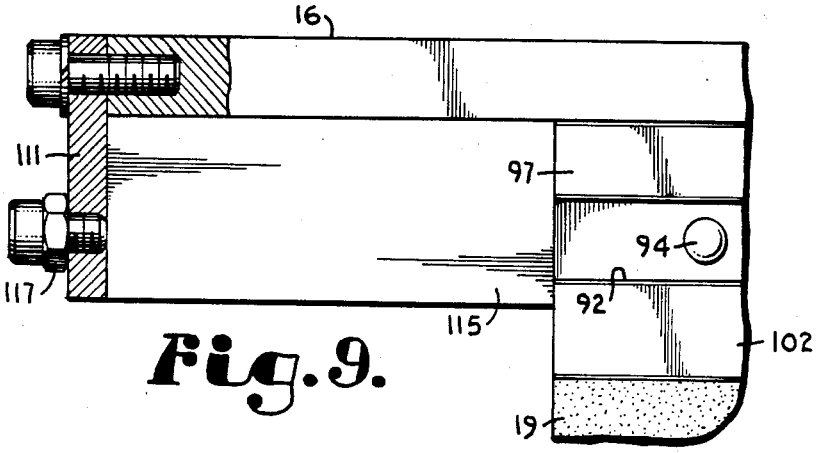
Fig. 9.
Fig. 10.
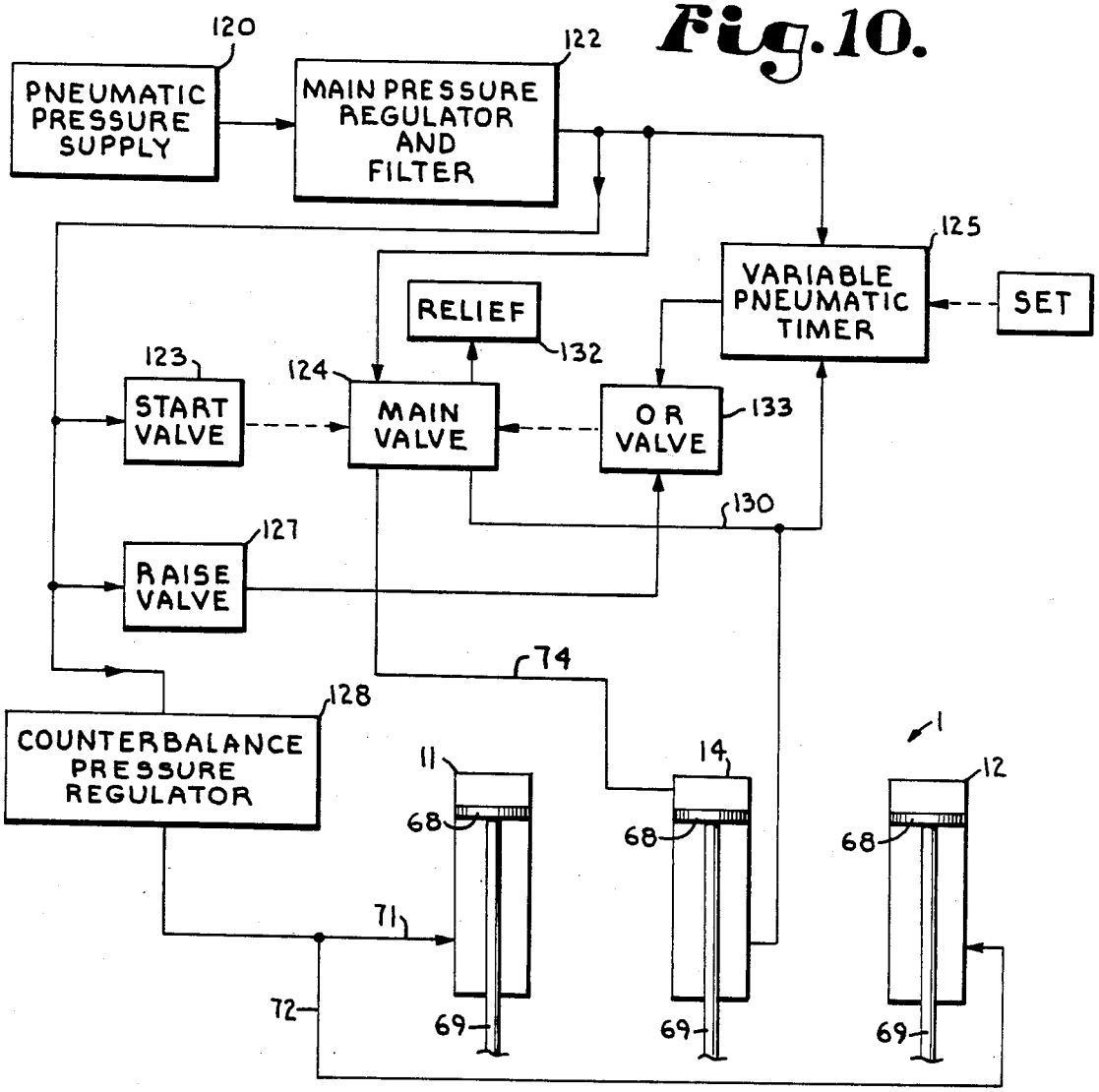

WIDE BELT SANDER CLEANING DEVICE

BACKGROUND OF THE INVENTION

The present invention relates to devices for cleaning abrasive sanding apparatus and particularly to such devices for routinely cleaning sanding belts during day-to-day operation.

In commercial sanding operations, large wide belt sanders are used to achieve a desired finish on the wood or particle board. The wide belt sanders come in many shapes and sizes from relatively simple machines with a single contact roller carrying a circumferential sanding belt to large, complex multi-roller machines for carrying continuous belts of great length. During the sanding operation, the surface of the abrasive belt fills, or loads, with materials abraded from the subject wood, and the surface of the belt becomes glazed. Eventually, the glaze significantly inhibits the sanding operation since it presents a smooth surface unsuitable for sanding. Industry practice was at one time simply to dispose of the clogged sanding belts once they became glazed. This practice was wasteful and expensive. This was true both in terms of the cost of the belts and in machine down time during changing of the belts. In certain operations, an entire plant comes to a halt when the sanding belt of a single sanding machine must be changed.

One solution to the disposal problem has been to take the belts from the machine and to place them on a roller assembly for scrubbing with a solvent to unload them. Subsequently, the belts are hung to dry for about a day. This adequately solves the problem of waste in the disposal of the belts. However, this does not solve the problem with machine down time during changing of the belt, since the belt still must frequently be changed.

It has been found that natural or synthetic rubber, such as natural honey crepe rubber, can be used to remove the excess material from the interstitial areas of the belt between the abrasive materials. It has been theorized that the abrasive action does not rub the excess material off, but rather, picks it out in small balls of material. The balls are formed when heat is generated by friction of the rubber against the belt and the material melts and grabs the pitch. However, previous apparatus and methods for using crepe rubber in this cleaning endeavor have proven to be unsatisfactory. In a commercial sanding operation, it is not feasible to use a hand-held device. Nor is it advisable to utilize apparatus that require adjustment of the working surface of the wide belt sander in order to accommodate a cleaning block.

OBJECTS OF THE INVENTION

The principal objects of the present invention are: to provide a cleaning device for a wide belt sander; to provide such a cleaning device which can be connected to an existing wide belt sander; to provide such a cleaning device which can automatically contact a natural rubber cleaning block to the sanding surface during normal operation; to provide such a cleaning block which includes a frame and cylinder arrangement for carrying a depending cartridge and rubber block assembly; to provide such a cleaning device which has apparatus for compensating cylinder pressure for maintaining the cartridge and block assembly in operative position on a sanding belt and at a selected pressure on the sanding belt; to provide such a cleaning device which compensates for the changing weight of the cartridge and block assembly as the block is worn away during use; to provide such a cleaning device which includes programmable apparatus for automatically compensating for the weight of the cartridge and block assembly as it varies during use; and to provide such a cleaning device which is relatively simple to use, economical to manufacture, and particularly well adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

A device for cleaning, or unloading, abrasive surfaces, e.g. belts used in wood sanding operations, includes a frame attached to the frame of a belt sanding machine. A retaining or cartridge assembly is carried by the frame and receives a block of natural or synthetic rubber cleaning material. The block is selectively moved into abrasive contact with a running belt for cleaning. The movement of the retainer assembly is controlled by withdrawal and projection means, such as a fluid-operated cylinder arrangement, which can be fluid or pneumatic. Also, movement of the retaining assembly can be achieved by mechanical actuation means. Hydraulic withdrawal, or lifting, cylinders at either end of the frame are set to lift the cartridge assembly and block in a direction out of contact with the sanding belt. A central fluid pressing, or projection, cylinder is used to overcome the upward force of the two outer cylinders, for forcing the block into operative contact with the belt when desired. It is envisioned that a single, dual directional fluid cylinder can be utilized with the present invention, such that the single cylinder constitutes the withdrawal and projection means. Controls are provided for regulating contact time with the belt depending on operating conditions. The controls may also be used to adjust the pressure in the cylinders to compensate for the changing weight of the block as it is worn away during use.

Natural honey crepe rubber has been found to be preferable for the present invention, although it is envisioned that alternative synthetic or natural rubbers could be utilized within the spirit of this invention. In practice, a block of rubber approximately $6\frac{5}{8}$ inches high and 2 inches thick has been found to be adequate. The width of the block varies depending on the width of the subject sanding belt to be cleaned, which can vary dramatically. For example, if the belt is 36 inches wide, the block is cut to be about $35\frac{1}{2}$ inches wide. Of the 6 $5\frac{5}{8}$ inch height, about $5\frac{5}{8}$ inches is usable, the remaining inch being used for gripping by the cartridge assembly and so that the cartridge assembly does not contact the sanding belt when the block is worn down. Such a block weighs about $14\frac{3}{4}$ lbs., and the cartridge assembly weighs about 4 lbs. Thus, the system must be able to support and compensate for about $14\frac{3}{4}$ lbs. of depending weight.

For many machines, the block can be $\frac{1}{2}$ inch narrower than the width of the sanding belt due to oscillation of the belt during sanding by well-known means. Many machines oscillate the belt laterally $\frac{1}{2}$–$\frac{3}{4}$ inches to increase the sanding effect. Since the belt is turned on in its normal fashion during the present cleaning operation, the belt continues to oscillate, due to pivotal movement of the idler roller, which effect is also felt on the cleaning block.

In practice, the 6 inch usable height of the rubber block has been found to be satisfactory. The amount of contact time between the rubber block and the sanding belt varies with the grit of the belt, for example 220 grit paper requires only about six seconds of contact time, whereas a 60 grit belt requires about 35 seconds of contact time. Additionally, the amount of rubber used during each cleaning operation varies, for example, a 100 grit belt may use as little as 1/16 inch of the rubber block per cleaning, while a 60 grit belt may use up about ⅛ inch of cleaner per cleaning. At ⅛ inch per cleaning, eight cleanings per inch are achieved, or 45 cleanings per block. In practice, with a 75 inch long by 36 inch wide belt, a 6 inch block has been found to last in the neighborhood of six to eight normal work shifts, depending on the grit of the belts being cleaned.

Although sensors can be used to detect when the belt is sufficiently loaded to require a cleaning, skilled operators can detect through use when a belt is loaded. For example, the sanding machine will pull a higher amperage when the belt is loaded. Also, the object board will tend to kick back from the machine when the belt is loaded up. Lastly, sanded boards will leave the machine with shiny streaks thereon when the belt is loaded up. Upon the detection of any of these circumstances, the operator would elect to clean the belt. In practice, using relatively hard woods, it has been found necessary to clean the belts when approximately 1,750 board feet of lumber has been run through the wide belt sander.

The cartridge assembly for holding the rubber block may be made in a disposable form such that the operator merely inserts a new combination cartridge assembly and rubber block when the usable quantity of the rubber block has been depleted. The cartridge has a longitudinal flange which is sized to be received onto a gib attached to the main frame of the cleaning device. A claw-like structure depends from the gib-engaging flange, and is used to grip a portion of the rubber block and securely hold it. The cartridge assembly is made in two halves and held together by rivets or other fasteners so that it can be placed around and grip the rubber block in an efficient manner.

The cleaning device frame is attached to an existing wide belt sander and an access hole is cut in the body of the sander. The size of the access hole is kept to a minimum in order not to affect substantially the vacuum within the sander body. The sander includes a vacuum device for removing the sanded material from the area, and it is important not to provide a source of air near the exit hose for the vacuum device. A vacuum sealing flange is provided on the infeed side of the frame for sealing the device, and the block fits between the sealing flange and the main body of the frame.

In order to allow the cartridge assembly to be changed, the frame is pivotable about one end and it can swing away from the sander body to allow a cartridge to be removed from the frame and a new one to be placed thereon. It is envisioned that the present apparatus could be used on different types of sanders that might require a horizontal arrangement of the frame, in which case the cartridge assembly would swing horizontally away from the sander body.

Preferably, the frame is made of a convenient size to accommodate the largest belt that can be used on a particular machine, but is adjustable to accommodate smaller sizes of belts. For example, sanding machines of from 36 to 42 inches are often times used, so it has been found that a 42 inch frame can be adapted to accommodate the cleaning of 36 inch machine belts. To do this, cartridge spacers are placed at each end of the shorter cartridge and block, such that the block is centered over the narrower sanding belt. On one end of the cartridge, the associated cartridge spacer has a plate for maintaining the unit in place. An adjustment screw is provided to take up end-play and reduce cartridge vibration.

In order to provide outfeed support for the block during use, a plate extends alongside the block in its operative position from the main frame of the cleaning device and the surface of the plate is coated with a plastic material, such as UMHV, such that the rubber block does not grab the metal plate so that the raising and lowering of the block is facilitated. The block is situated in touching contact with the plate to alleviate the loss of vacuum problem.

The fluid cylinders are attached to air lines that are associated with the compressed air source for the wide belt sander, such that the sander does not operate without air being supplied to the cylinders. This is important because, when the system is shut off completely, the cylinders will not hold the block out of contact with the idler roller, but instead the block rests thereon. However, when the sander is turned on, air is immediately supplied to the outer cylinders for raising the block to its neutral position.

In a first embodiment of the present invention, the system utilizes a pneumatic timer for controlling the contact time between the rubber block and the sanding belt. The operator sets the timer based on empirical data developed through use, but the time will vary depending on the coarseness, or grit, of the sanding belt. In this embodiment, the pressure in the outer cylinders is set, as is the pressure in the central cylinder. The downward cylinder is set to provide a greater downward force than the upward force of the combined outer cylinders, thereby creating a pressure differential which presses the block downward into contact with the sanding belt. This pressure differential is a few pounds, and will not vary as the block is worn away. Thus, the pressures are set at an average pressure which would actually be ideal only for the block when half of it has been worn away. However, for economic reasons, this system can be used to save cost.

In a second embodiment of the invention, a programmable controller is used to count the number of cleanings and infer the weight loss associated with each cleaning. This weight loss is used to recalculate the pressures needed in the cylinders to provide a preferred pressure differential such that the pounds per square inch (psi) of pressure being applied to the sanding belt is optimized. The programmable controller is programmed to vary the calculations based on the grit of the sanding belt being used, and the operator must feed this information (the grit) to the programmable controller during use.

In a second alternative embodiment, the system also varies with the grit of the sanding belt, which is supplied by the operator. However, the system utilizes a linear position measurement device to calculate the amount of the rubber block that is remaining prior to each use, such that a more accurate calculation of the weight of the cartridge and block assembly can be performed. This allows the programmable controller to control more accurately the pressures in the cylinders to provide the optimum downward pressure.

The drawings constitute a part of this specification and include exemplary embodiments of the present invention and illustrate various objects and features thereof.

BRIEF DESCRIPTION OF THE DRAWINGS

FIG. 9 is an enlarged, fragmentary front elevational view of a modified cartridge assembly and showing a cartridge spacer, with portions broken away.

FIG. 10 is a schematic diagram of a first embodiment of the present invention.

DETAILED DESCRIPTION OF THE INVENTION

Figure 1:
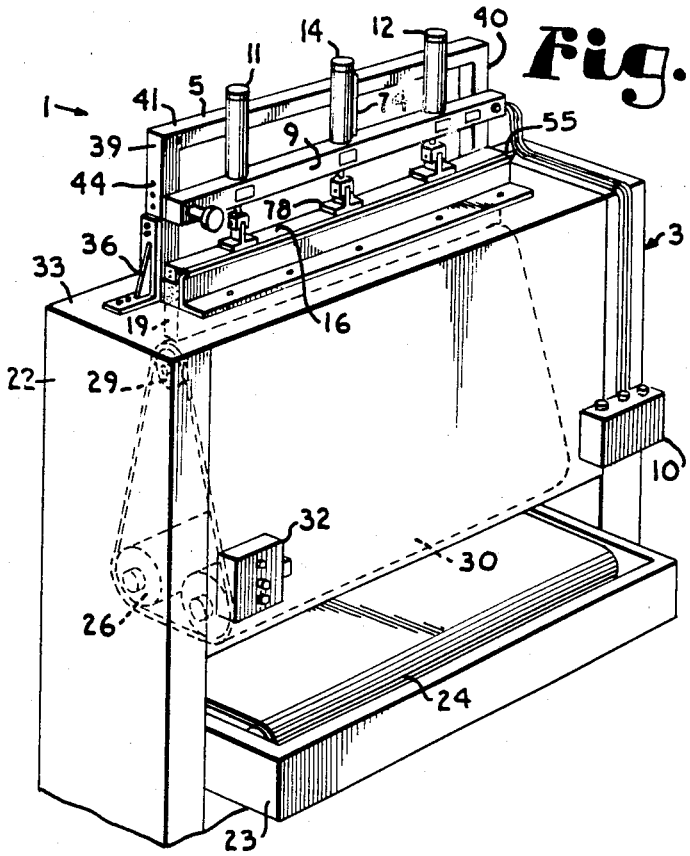
FIG. 1 is a perspective view showing a cleaning device of the present invention in place on a wide belt sander, with hidden portions of the sanding belt and roller assemblies shown in phantom lines.
Figure 2:
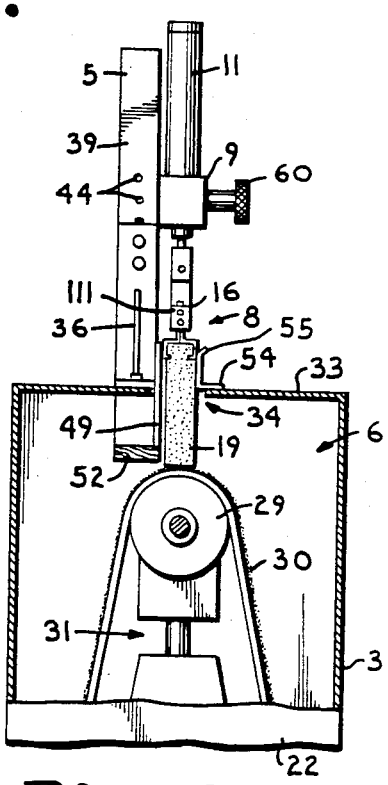
FIG. 2 is an enlarged, fragmentary side elevational view of the cleaning device in place on the sander, with portions broken away.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring in more detail to the drawings, reference numeral 1 generally indicates a wide belt sander cleaning device, which is attached to an abrasive apparatus, such as a wide belt sander 3. A main frame 5 of the cleaning device 1 extends through an access hole into an interior cavity 6 of the sander 3. A retaining assembly 8 depends from holding means, such as a mounting tube 9. Withdrawal means, such as first and second fluid lifting cylinders 11 and 12, is mounted on the tube 9. Projection means, such as a central fluid pressing cylinder 14, is mounted to the tube 9 and is designed to exert downward pressure on the retaining assembly 8. Operation of the device 1 is controlled by an operator through a control box 10.

The retaining (cartridge) assembly 8 includes a cartridge holder 16 connected to each of the fluid cylinders 11, 12, and 14 and depending therefrom. A cartridge 17 is adapted to be slidable onto the cartridge holder 16 and to firmly hold a cleaning block 19. The cleaning block 19 is illustrated as being made of a natural honey crepe rubber.

The wide belt sander 3, upon which the cleaning device 1 is installed, includes a body 22 having a working table 23 with a conveyor belt 24 thereon. Appropriate motive means (not shown), such as electric motors and the like, are included to provide power to the conveyor 24 and to a drive roller or rollers 26 and 27, which are arranged in the cavity 6 of the sander 3 in various configurations well known in the art. In the illustrated example, an idler roller 29 is situated in the cavity 6 near a top of the sander body 22. An abrasive surface, such as a sanding belt 30 is received onto the drive rollers 26 and 27, and the idler roller 29 and is removable therefrom for replacement.

Vacuum means are provided for removing debris from the body interior 6. The illustrated sander 3 also includes oscillation means 31, which are well-known in the art for pivoting the idler roller 29 about a vertical axis and through a short (about $\frac{5}{8}$ inch) stroke for increasing the sanding effect.

Appropriate electronic controls 32 are provided on the machine. Thus, an appropriate working environment is provided for the present invention.

The cleaning device 1 of the present invention can be attached to the sander 3 at any appropriate location, and is illustrated as being attached to a top surface 33 of the sander body 22. An access hole 34 is cut into the machine for receiving the cleaning device 1. Angle brackets 36 and 37 are attached to the body top surface 33 and to the main frame 5 for holding the cleaning device 1 in position.

Figure 5:
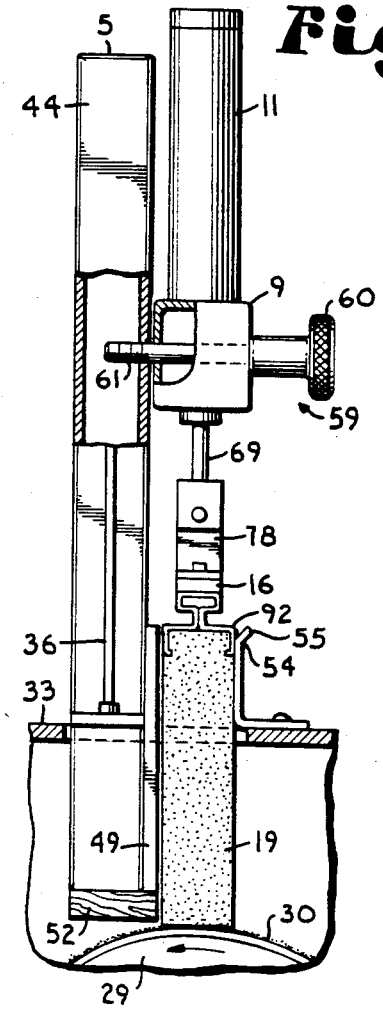
FIG. 5 is an enlarged, fragmentary end elevational view of the cleaning device and sander with portions broken away.
Figure 6:
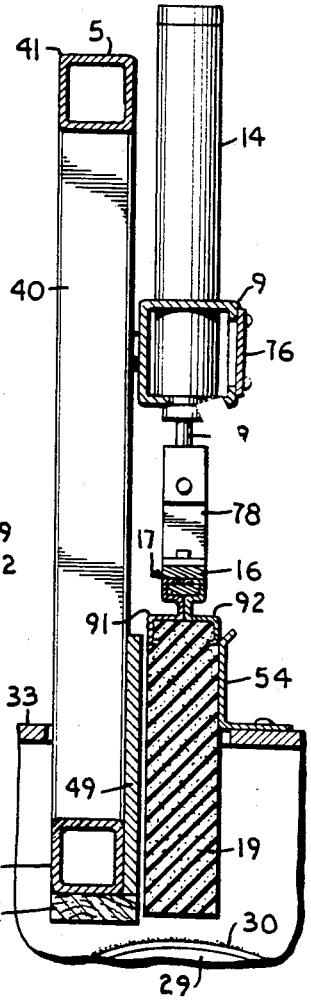
FIG. 6 is an enlarged, fragmentary cross-sectional view taken along line 6—6, FIG. 3.

The main frame 5 is generally rectangular in shape and fabricated from square tubing. First and second vertical standards 39 and 40 are interconnected by an upper frame member 41 and a lower frame member 42. First and second vertical standards 39 and 40 are adjustably mounted to the angle brackets 36 and 37, respectively. The first and second vertical standards 39 and 40 include a plurality of holes 44 for receiving connectors, such as screws, from the angle brackets 36 and 37 at a desired vertical positioning of the main frame 5. This vertical positioning depends on the particular configuration of the sander 3, and particularly the positioning of the idler roller 29. The frame 5 is adjusted such that it is in close proximity to the sanding belt 30, as seen in FIGS. 5 and 6.

A plate 49 is attached, as by welding, to the lower frame member 42 and the first and second vertical standards 39 and 40. The plate 49 extends upwardly from a bottom of the lower frame member 42 a distance generally corresponding to the height of the illustrated cleaning block 19. As can be seen in FIG. 6, the cleaning block 19 is positioned in close proximity to the plate 49, and actually contacts the plate during use. The plate 49 is coated with a plastic material such that the rubber cleaning block 19 slides therealong without grabbing the steel material from which the plate 49 is made. The purpose of the plate is to provide outfeed support to the block 19 during the sanding operation when the block 19 is in a contact position with the abrasive surface. When the block 19 contacts the moving sanding belt 30, the momentum of the belt tends to force the block in the direction of rotation. The plate 49 prevents this and thus prevents the block from tearing away from the cartridge assembly. Additionally, the plate tends to hold the block in position to present a uniform block working surface to the belt 30. Due to oscillation of the belt 30, the block 19 is generally evenly worn away.

Attached to the bottom of the lower frame member 42 is a strip of wood 52, which extends along the length of the lower frame member 42. As seen in FIGS. 5 and 6, the wood strip 52 is only a fraction of an inch away from the sanding belt 30. The wood strip 52 is used to provide an expendable surface for the sanding belt 30 to rub against as the belt 30 becomes loose during normal operation. That is, the belt 30 will occasionally become loose enough to strike against the wood strip 52. If the lower frame member 42 was not provided with this wood strip, the sanding belt 30 would strike against the lower frame member 42, which would lead to rapid deterioration of the sanding belt 30.

A sealing flange 54 is attached to the sander body 22 along the top surface 33 thereof. The sealing flange 54 is positioned such that the cleaning block 19 and cartridge assembly 8 substantially fill the space between the plate 49 and the sealing flange 54 such that the vacuum conditions in the interior cavity 6 are not substantially affected by the presence of the cleaning device 1. A lip 55 is provided on the sealing flange 54 to facilitate entry of the cleaning block 19 into the interior cavity 6.

The mounting tube 9 is pivotally attached at a second end 56 thereof to the second vertical standard 40. In its operating position, the mounting tube 9 is generally horizontally positioned and a first end 57 thereof is held in place on the first vertical standard 39 by a securing knob assembly 59. The knob assembly 59, as seen in FIG. 5, includes a knurled knob 60 and rotatable screw 61 extending from the knob 60. The screw 61 extends through a threaded hole in the vertical standard 39 to position the mounting tube 9 in its generally horizontal position.

Figure 3:
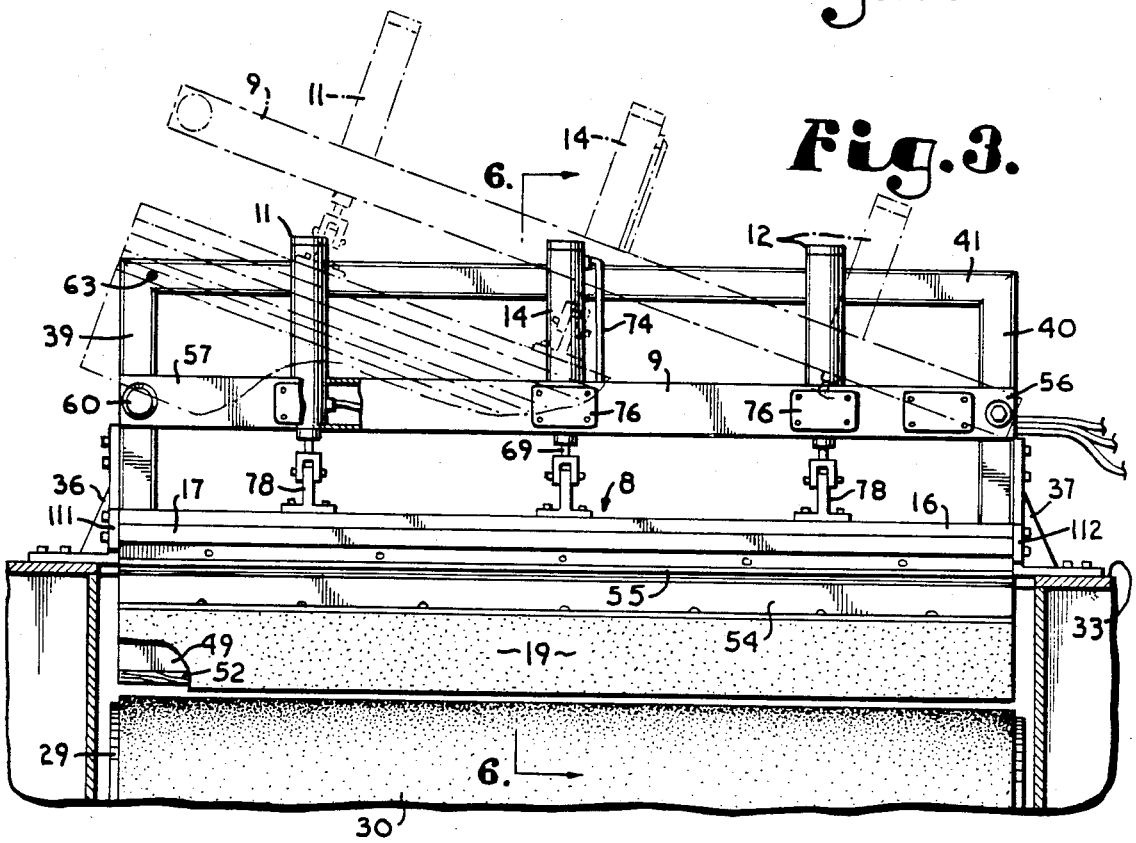
FIG. 3 is an enlarged, fragmentary front elevational view of the cleaning device and wide belt sander, and showing, in phamtom lines, an exaggerated pivoting position of a portion of the cleaning device.
Figure 4:
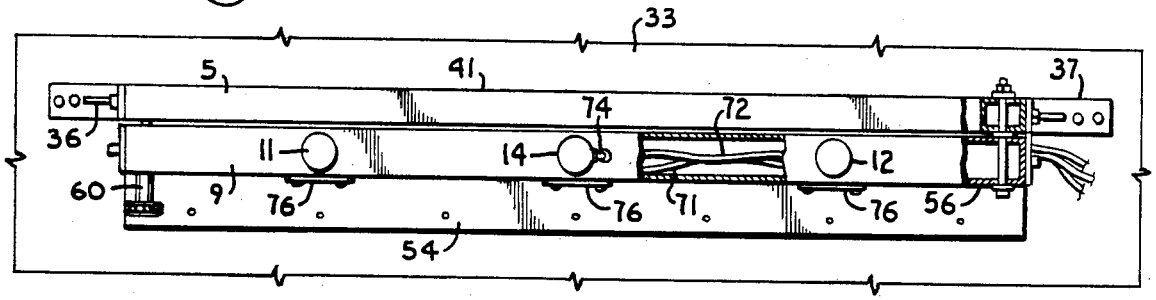
FIG. 4 is an enlarged, fragmentary top plan view of the cleaning device and sander, with portions broken away.

In order to change the cartridge assembly 8 and cleaning block 19, the mounting tube 9 is pivotable upwardly, as seen in FIG. 3. The mounting tube 9 includes another hole 63, which receives the screw 61 for holding the mounting tube 9 in a pivoted position to allow the cartridge assembly 8 and cleaning block 19 to be removed. In FIG. 3, the pivot tube 9, cartridge assembly 8, and cleaning block 19 are shown in phantom lines in an exaggerated pivoted position for clarity of the drawing. In practice, however, the mounting tube 9 is pivoted to a point such that the screw 61 can be screwed into the hole 63.

The fluid cylinders 11, 12, and 14 constitute weight compensation means for holding the cartridge assembly 8 and cleaning block 19 and selectively lowering same into contact with the sanding belt 30 for cleaning purposes. The cylinders 11, 12, and 14 are connected by hoses to an appropriate air source (not shown) which supplies air to the cylinders at a desired pressure. As illustrated, the fluid cylinders 11, 12, and 14 are standard air units wellknown in the art.

The first and second fluid cylinders 11 and 12 are mounted on the mounting tube 9 near the respective first and second ends 57 and 56 thereof. Each of the first and second fluid cylinders 11 and 12, as well as the central fluid cylinder 14, include a respective inner piston 68 and piston rod 69, which are standard in the industry. The first and second fluid lifting cylinders 11 and 12 are connected to the air source by respective hoses 71 and 72, which are in flow communication with the first and second cylinders 11 and 12 on a proximal side of the pistons 68, such that increased air pressure in the first and second cylinders 11 and 12 tends to force the respective piston 68 and rod 69 away from (or as illustrated, upwardly) the mounting tube 9 and sanding belt 30. The first and second cylinders 11 and 12 are generally pressurized sufficiently to maintain the cartridge assembly 8 and cleaning block 19 in an elevated position, as seen in FIG. 6.

The central pressing cylinder 14 is connected to the air source through a hose 74. The hose 74 is connected to a distal end of the cylinder such that air is fed into the cylinder on a distal side of the piston 68. Thus, when air is fed into the central cylinder 14, the piston 68 and rod 69 tend to move toward (or as illustrated, downwardly) the sander 3 and specifically sanding belt 30. The function of this weight compensation system is further explained below.

The mounting tube 9 is provided with access covers 76, which cover holes for providing access to the various cylinders 11, 12, and 14.

Figure 8:
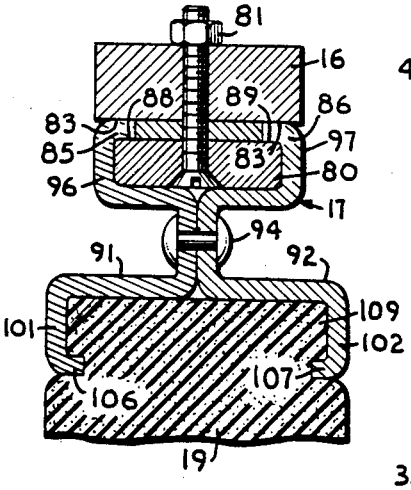
FIG. 8 is an enlarged, fragmentary end elevational view of the cartridge assembly and rubber block with portions broken away.
Figure 7:
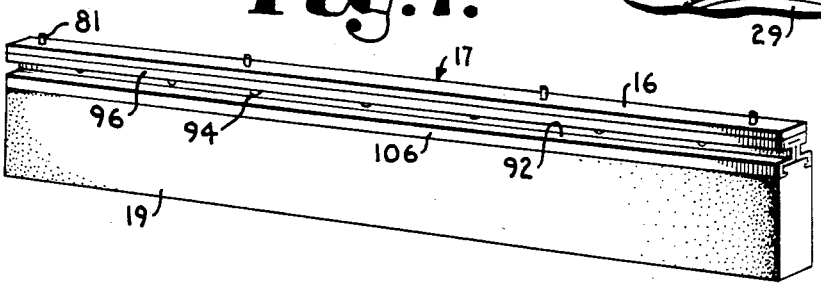
FIG. 7 is a perspective view of a cartridge assembly of the cleaning device with a rubber cleaning block in place thereon.

The cartridge assembly 8 depends from outer, or lower, ends of the fluid cylinder piston rod 69, as seen in FIG. 3. Specifically, the cartridge holder 16, which is an elongate beam, includes three lugs 78 for connection to outer ends of the respective piston rods 69. The holder 16 includes a gib 80 which extends the length of the holder 16 and is attached thereto by a plurality of nut and bolt assemblies 81. As can be seen in FIG. 8, a notch 83 formed between the gib 80 and cartridge holder 16 is sized to receive opposed securing flanges 85 and 86 of the cartridge 17. The notch 83 also forms bearing surfaces 88 and 89 on the gib 80.

As illustrated, the cartridge 17 is formed from a first cartridge half 91 and a second cartridge half 92. The first and second cartridge halves are mirror images of one another and are fastened together by appropriate fastening means, such as a plurality of rivets 94. Respective first and second upper segments 96 and 97 of the first and second cartridge halves 91 and 92 are formed to fit around the gib 80 and include the securing flanges 85 and 86, such that the cartridge 17 can be slid into the notches 83. Thus, the cartridge assembly 17 is supported by the bearing surfaces 88 and 89 of the gib 80.

First and second lower segments 101 and 102 of the first and second cartridge halves 91 and 92, respectively, include first and second claw members 106 and 107. In the making of a disposable combination cartridge assembly and cleaning block, the cleaning block 19 is cut to the desired size. The cartridge holder 16 is secured to the block 19 by placing unconnected first and second cartridge halves 91 and 92 along a top portion 109 of the block 19, and then the cartridge halves are fastened together, as by the plurality of rivets, to form a combined cartridge and block. This unit can then be slid along the gib 80 of the cartridge holder 16 when the mounting tube 9 is in its upwardly pivoted position for use in cleaning.

To hold the cartridge 17 and block 19 in position, opposed first and second end plates 111 and 112 are included. The end plates 111 and 112 are fastened to the cartridge holder 16, a either end thereof. The first end plate 111 is removed when it is necessary to change the cleaning block 19.

As illustrated, the cleaning device 1 is adaptable to different widths of sanding belts 30. If the belt 30 is narrower than the length of the frame 5 and cartridge holder 16, a pair of spacer blocks 115 is used. Equal sized blocks 115 are placed at either end of the combined cartridge holder and cleaning block, to position same over the sanding belt. The spacer block is formed to be slidable onto the cartridge holder gib 80, as seen in FIG. 9. An adjusting screw 117 screws into and through the first end plate 111 for pressing against the spacer block 115 to take up end-play and reduce cartridge vibration.

FIG. 10 illustrates a schematic diagram of a first embodiment of the present invention. It is stressed that the embodiments of the invention described herein are not to be considered limiting in nature, but rather are given as illustrative examples of means for controlling the weight compensation means, and specifically the fluid (pneumatic) cylinders.

A pneumatic pressure supply 120 is connected to a main pressure regulator and filter 122. The various connections referred to herein are made by means of appropriate fluid lines, such as air hoses and fittings. The supply air is connected through the regulator 122 to a start valve 123, a pilot-controlled main valve 124, and a pilot-controlled variable pneumatic timer 125. The line connected to the start valve 123 is also connected to a raise valve 127 and counterbalance pressure regulator 128.

The counterbalance pressure regulator 128 is connected to the first and second cylinders 11 and 12, and supplies air thereto at a selected pressure. The pressure supplied to the first and second cylinders 11 and 12 is the amount necessary to offset the combined weight of the cartridge assembly 8 and cleaning block 19, and is determined for the specific assembly being used. The regulator 12B is variable such that adjustment of the system is possible.

In the present embodiment, the counterbalance pressure is constantly supplied to the first and second cylinders when the wide belt sander 3 is turned on, since the pneumatic pressure supply 120 is connected to the compressed air means for the sander 3.

The main valve 124 receives air from the main pressure regulator 122, but is in a normally closed position such that air does not flow through the main valve 124. The main valve 124 is connected by the central cylinder hose 74 to a distal side of the central cylinder 14, such that, when air is supplied thereto, the pressure tends to push the piston 68 and rod 69 downwardly toward the sanding belt 30.

The main valve can be opened in two ways, the first being by use of the start valve 123. The operator pushes a button on the valve 123. The button for the start valve 123 is located on the cleaning device control box. Upon an operator pushing the button, the pressure available to the valve 123 is transmitted through a line to control means, such as a pilot, in the main valve 124. This connection is shown by a dashed line between the start valve 123 and main valve 124. The pilot actuates the main valve 124 to open the line 74 to receive pressure from the main pressure regulator 122, thereby supplying compressed air to the central cylinder 14 for lowering the cleaning block 19 into operative contact with a sanding belt 30.

The supplied air from the main pressure regulator 122 to the pressing cylinder 14 is set at a desired pressure sufficient to overcome the pressure in the first and second lifting cylinders 11 and 12. In practice, it has been found that less than ½ p.s.i. of applied pressure at the surface of the cleaning block 19 is sufficient. This translates to a pressure differential between the central cylinder 14 and the first and second cylinders 11 and 12 of about 4 or 5 p.s.i. The main pressure regulator 122 can be adjusted to supply varying degrees of pressure to the air supply lines, and the counterbalance pressure regulator 128 is used to supply the desired pressure differential to the uplifting first and second fluid cylinders 11 and 12.

The variable pneumatic timer 125 is provided to control the contact time between the cleaning block 19 and the sanding belt 30. The operator sets a timer control dial at a specified amount, usually from about 6 to 35 seconds, depending on the grit rating of the sanding belt 30. The pneumatic timer 125 is a device that is well-known in the art and it will not be described in detail. The pneumatic timer 125 includes standard valves, a throttle, and an accumulator. The timer is connected to the main pressure regulator 122, but air does not flow through the timer valves when the pneumatic timer 125 is in its neutral position.

It is also seen that the pneumatic timer 125 is connected to the main valve 124. In the neutral position, the main valve 124 allows air to flow from the main pressure regulator 122 through the main valve 124 to the pneumatic timer 125 and a distal side of the central cylinder 14, through line 130. This pressure maintains the pneumatic timer in its neutral position. However, when the start valve 123 is actuated, the pilot on the main valve 124 closes line 130 and opens line 74 to receive the pressurized air. This air acts on the distal side of the central piston 68, which tends to push the piston downwardly. The air on the proximal side of the piston 68, in order for the piston 68 and rod 69 flows from the central cylinder 14 through line 130. The main valve 124 is closed to flow in that direction, except through a first outlet in a relief port 132. The relief port 132 is set to relieve at a specified pressure slightly higher than the normal pressure in the lines.

Thus, the pressure in line 130 will be raised slightly before relieving, which raised pressure is used to actuate a pilot in a valve of the pneumatic timer, setting the timer into operation. The pilot opens the valve in the pneumatic timer 125 to allow airflow from the main pressure regulator 122 through a timing throttle and into an accumulator. The timer controls the rate of flow of the air into the accumulator until, at the desired time, the accumulator is full and pressure begins to build within the pneumatic timer. At that point, a pilot in another valve of the pneumatic timer actuates that valve to apply the pressure in the system to an "Or" valve 133. The Or valve 133 is connected to a second pilot in the main valve 124 such that when the air flows from the pneumatic timer 125 to the Or valve 133, the increased pressure actuates the main valve to close same. This shuts off flow to the distal side of the central pressing cylinder, allowing the pressure in the first and second lifting cylinders 11 and 12 to raise the cartridge assembly 8 and cleaning block 19. The air from the distal side of the central fluid cylinder 14 is relieved through a second outlet in the relief port 132.

The raise valve 127 is provided for emergency raising of the cartridge assembly 8 and cleaning block 19 during operation. The raise valve 127 is connected to the Or valve 133 such that, when the raise valve 127 is actuated, air flows to the Or valve and actuates the shut-off pilot in the main valve 124, thus immediately raising the cartridge assembly and cleaning block and overriding the pneumatic timer 125.

Through regulation of the main pressure regulator 122 and counterbalance pressure regulator 128, substantially any desired pressure differential can be utilized to provide appropriate sanding pressur to the sanding belt 30. In the present embodiment, the counterbalance pressure does not take into account the changing weight of the cleaning block 19 as the block is worn away during use. Rather, the pressure is set at a calculated desired pressure for the system when approximatly one-half of the block has been worn away. This has been found to be within acceptable tolerances for many uses through the entire length of usable cleaning block.

It is further noted that the stroke of the central fluid cylinder 14 is limited in that the piston 68 bottoms out before the cartridge 17 strikes the sanding belt 30, and preferably a slight waste amount of the cleaning block 19 is provided to ensure that the cartridge 17 does not contact the sanding belt 30.

Figure 11:
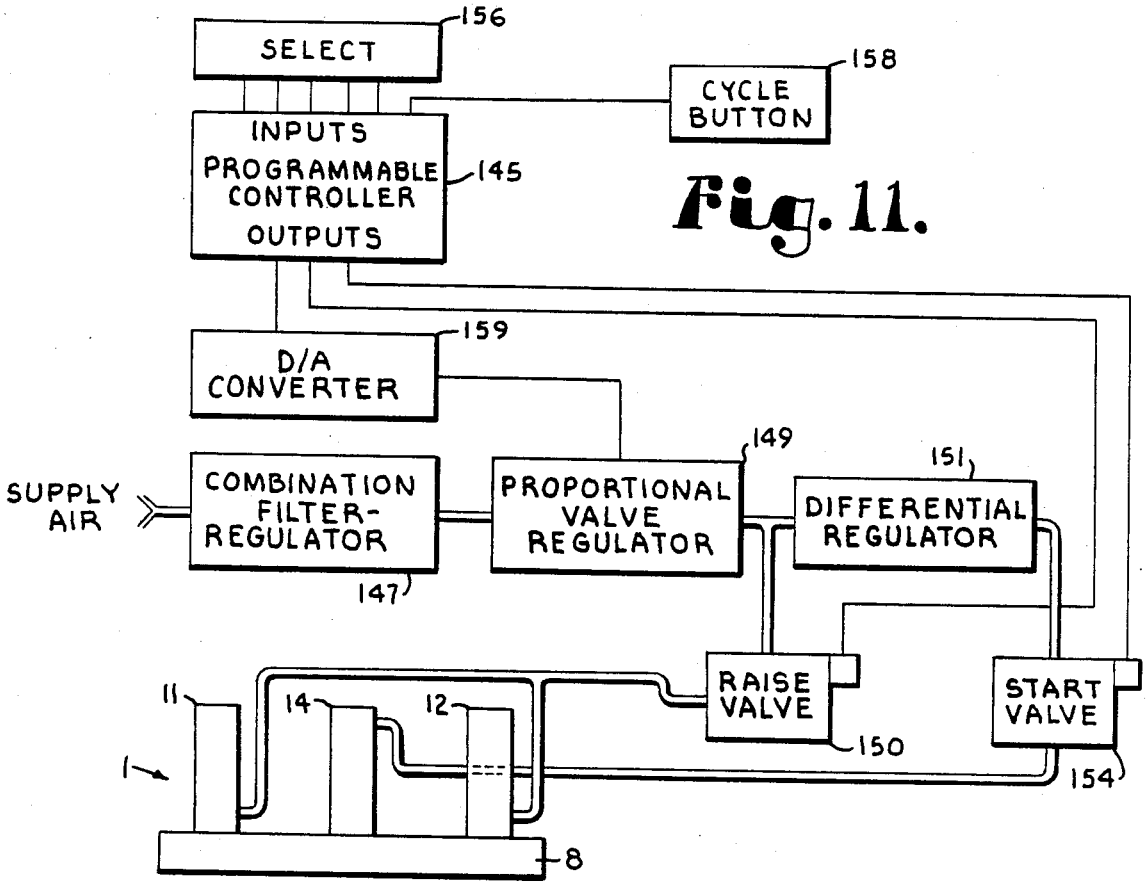
FIG. 11 is a schematic diagram of a second embodiment of the present invention.

A second embodiment is shown in the schematic diagram of FIG. 11. In this embodiment, a programmable controller 145 is used to control the contact time with the cleaning block 19 and to regulate the pressure differential between the fluid cylinders by use of a counter. The programmable controller is placed in the cleaning device control box 10 and the controller itself can be of any standard type known in the industry that can accommodate the functions outlined below.

In FIG. 11, electrical connections are indicated by single lines, while air line connections are indicated by double lines.

Supply air is made available to a combination filter-regulator 147, which controls the air pressure made available to the system. The combination filter-regulator 147 is connected to a proportional valve regulator 149, which in turn is connected to a raise valve 150 and a differential regulator 151. The raise valve 150 is connected to the first and second lifting cylinders 11 and 12, on the proximal side of the piston 68 thereof. The differential regulator 151 is connected to a start valve 154, which in turn is connected to the distal side of the central pressing cylinder 14. The start valve 154 is substantially similar to the main valve 124 of the first embodiment and operates in a like manner. A series of select switches 156 (indicated by SELECT in the drawing) is provided and is connected to the programmable controller to provide input therto. The select switches 156 are used to indicate the grit of the sanding belt, and the programmable controller 145 is programmed to vary the contact time depending on the grit selected. A cycle button 15B is also connected to the programmable controller 145 and provides input thereto. The cycle button 158 is actuated by the operator after a specified grit is selected. The controller 145 is connected to a digital-analog (D/A) converter 159, which in turn is connected to the proportional valve regulator 149 and is used to convert the output from the controller 145 into signals that can be used to operate th proportional valve regulator 149.

The programmable controller 145 also has output lines connected to the raise valve 150 and start valve 154.

The weight compensation pneumatic system works in the previously described manner, but is controlled differently to account for the decreasing weight of the cleaning block 19 as it is used up. In this embodiment, the programmable controller 145 includes a counter, which is set to zero for each new cleaning block 19. It is known that, in one embodiment of the block 19, approximately 48 cleanings can be obtained from a six inch high cleaning block. Thus, each time the cleaning device 1 is cycled by actuation of the cycle button 158, the controller counts the cycle. The controller 145 then varies the pressure in the system through the proportional valve regulator 149 to decrease the pressure in the first and second cylinders 11 and 12, since a lesser amount of pressure is necessary to support the decreasing weight of the cleaning block 19. Ths allows the operator to maintain finer control over the system and more closely approximate the optimum cleaning pressure on the belt 30.

As before, the start valve is opened when it is desired to operate the device 1 through a cycle. In this example, the programmable controller 145 is connected to the start valve 154 for operating same. In a like manner, the programmable controller 145 is connected to the raise valve 150 for emergency deactuation of the system.

The differential regulator 151 is used to maintain the proper pressure differential between the cylinders 11 and 12 and the central cylinder 14. The proportional valve regulator 149 supplies a proportion of the available air to the first and second cylinders 11 and 12 and a proportion of the air to the central cylinder 14.

The raise valve is actuated through the programmable controller by contacting one of the buttons in the select unit 156.

Figure 12:
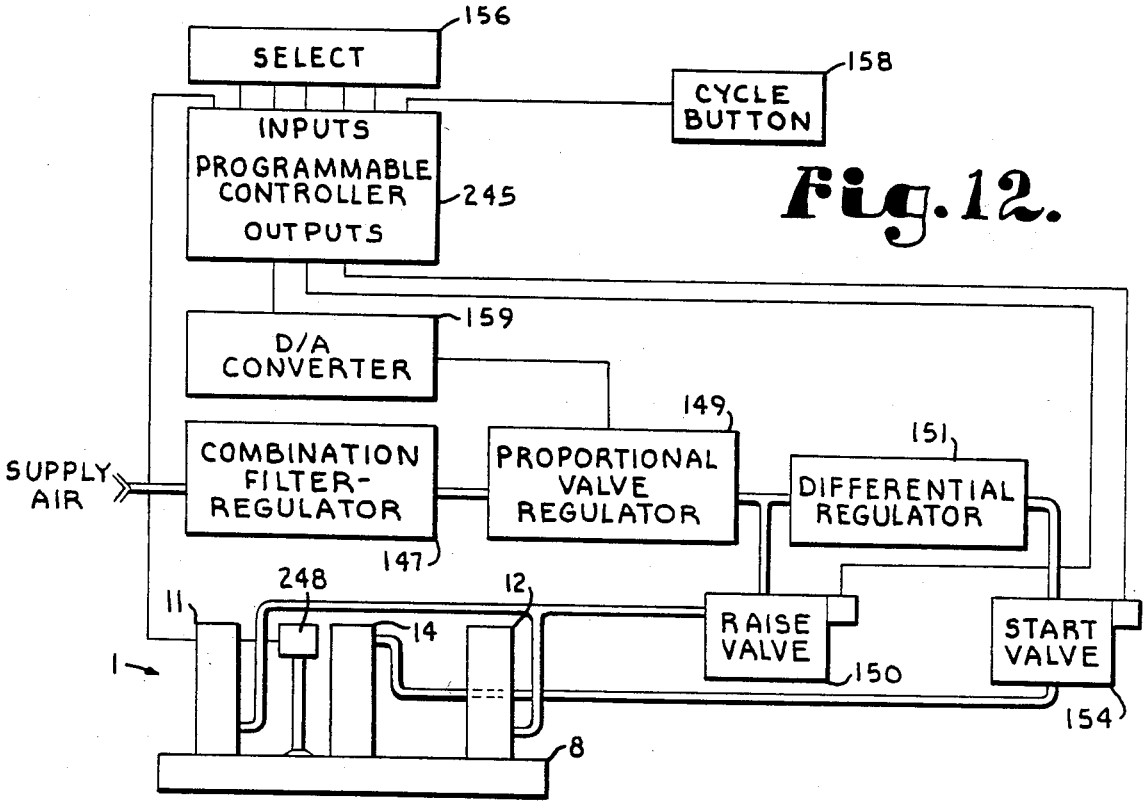
FIG. 12 is a schematic diagram of a third embodiment of the present invention.

A third embodiment of the present invention is shown schematically in FIG. 12. In this embodiment, the basic control system is substantially similar to that shown in FIG. 11, and the present discussion is directed only to the differences between the second and third embodiments.

A programmable controller 245 is programmed differently from the programmable controller 145 as will be explained. Instead of counting the number of cycles through which the system has been put, the programmable controller 245 receives input from a linear position measurement device 248.

The measurement device 248 is used to determine the linear position, or displacement, of the cartridge assembly and cleaning block relative to the mounting tube for each cycle, whereby calculations can be made by the programmable controller 245 to closely approximate the actual remaining weight of the cleaning block 19 and cartridge assembly 8. This information is used for each succeeding cycle, and the programmable controller will vary the available pressure in the system depending on the input from the linear position measurement device 248.

The linear postion measurement device 248 can take many different forms, including a rack and pinion device, and it is also possible to use servo motors, or various capacitive, inductive, or resistive devices that are well-known in the art. It is important only to utilize a standard measurement device to provide input to the programmable controller 245 so that it can calculate the actual displacement and utilize that information to calculate the remaining weight for varying the pressure in the system.

It is to be understood that while certain forms of the present invention have been illustrated and described herein, it is not to be limited to the specific forms or arrangement of parts described and shown.

What is claimed and desired to be secured by Letters Patent is as follows:

1. A cleaning device for a wide belt sanding machine, the sanding machine including an abrasive belt that revolves around a roller during normal operation; said cleaning device comprising:

(a) a frame adapted to be attached to the sanding machine; said frame extending into the sanding machine in a close proximity to the roller;

(b) a mounting tube with opposite ends, said mounting tube being pivotably connected to said frame at one of said ends;

(c) withdrawal means connected to said mounting tube and including a fluid-actuated lifting cylinder mounted on said mounting tube and having a piston and piston rod;

(d) projection means connected to said mounting tube and including a fluid-actuated pressing cylinder mounted on said mounting tube and having a piston and piston rod;

(e) a retaining assembly connected to outer ends of said lifting cylinder piston rod and said pressing cylinder piston rod; said retaining assembly including a cartridge holder connected to said piston rod outer ends, said cartridge holder extending generally parallel to the sanding machine roller; said retaining assembly further including a cartridge sized to be received onto said cartridge holder and removable therefrom;

(f) a block of cleaning material for removing accumulated material from the abrasive belt when in a contact position therewith; said block being held by said cartridge in close proximity to the abrasive belt;

(g) control means associated with said withdrawal means and protection means; said control means selectively actuating said lifting cylinder to maintain the cleaning block in a withdrawn position away from said abrasive belt; said control means alternatively actuating said pressing cylinder for applying a greater and opposite force than does said lifting cylinder for moving said retaining assembly and the associated cleaning block toward the abrasive belt and into said contact position therewith for cleaning thereof; and (h) said mounting tube and said retaining assembly being pivotably movable between an operative position with said block within said sanding machine and a block replacement position with said block at least partly outside said sanding machine.

2. The device as set forth in claim 1 wherein:

(a) said control means are adapted to actuate said pressing cylinder to force the cleaning block against the abrasive belt for a selected period of time.

3. The device as set forth in claim 2 wherein:

(a) said control means include a pneumatic variable timer.

4. The device as set forth in claim 2 wherein:

(a) said control means include a programmable controller operatively connected to said lifting cylinder and said pressing cylinder and being programmable to vary the contact time of said cleaning block against the abrasive belt upon selection by the operator; and (b) said programmable controller is programmable to count a number of cleaning cycles of said cleaning block against the abrasive belt, calculate an estimated remaining weight of said cleaning block, and using the estimated weight, calculate new desired pressures in said lifting and pressing cylinders for varying the pressures accordingly.

5. The device as set forth in claim 2 wherein:

(a) said control means includes a programmable controller;

(b) said control means includes a linear position measurement device operatively connected to said programmable controller;

(c) said programmable controller is operatively connected to said lifting and pressing cylinders to vary the pressures therein; said programmable controller is programmed to vary the contact time between said cleaning block and the abrasive belt in response to data presented thereto by the operator;

(d) said linear position measurement device is adapted to sense and record changes in displacement of said retaining assembly relative to said frame as the cleaning block wears away during a number of cycles of contact time; said linear position measurement device is connected to said programmable conroller, whereby data representing the displacement of said cartridge assembly is communicated to said programmable controller; and (e) said programmable controller is programmed to receive the data representing the displacement of said cartridge assembly and to calculate a remaining weight of said cleaning block for varying the pressures in said lifting cylinder and said pressing cylinder in response thereto.

6. The device as set forth in claim 1 further including:

(a) a plate connected to said frame and being positioned adjacent said cleaning block for providing lateral support thereto during cleaning of the abrasive belt.

7. The device according to claim 1 wherein:

(a) said block is constructed of honey crepe rubber.

8. The device according to claim 1 in combination with:

(a) a sanding apparatus having an endless sanding belt.

9. A cleaning device for a wide belt sanding machine, the sanding machine including an abrasive belt that revolves around a roller during normal operation; said cleaning device comprising:

(a) a frame adapted to be attached to the sanding machine; said frame extending into the sanding machine in close proximity to the roller;

(b) a mounting tube connected to said frame and having opposite ends;

(c) withdrawal means connected to said mounting tube;

(d) projection means connected to said mounting tube;

(e) one of said withdrawal and projection means comprising fluid-actuated first cylinder means mounted in proximity to a respective mounting tube end and including a piston and a piston rod;

(f) the other of said withdrawal and projection means comprising fluid-actuated second cylinder means mounted adjacent said first cylinder means and having a piston and a piston rod;

(g) a retaining assembly including:

(1) a cartridge holder connected to said piston rods and extending generally parallel to the sanding machine roller; and (2) a cartridge sized to be received onto said cartridge holder and removable therefrom;

(h) a block of cleaning material for removing accummulated material from the abrasive belt when in a contact position therewith, said block being held by said cartridge in close proximity to the abrasive belt; and (i) control means associated with said withdrawal means and projection means: said control means selectively actuating said withdrawal means to maintain the cleaning block in a withdrawn position away from said abrasive belt; said control means alternatively actuating said projection means for applying a greater and opposite force than does said withdrawal means for moving said retaining assembly and the associated cleaning block toward the abrasive belt and into said contact position therewith for cleaning thereof.

10. A device for cleaning moving abrasive surfaces comprising:

(a) a frame adapted to be attached to an abrasive apparatus;

(b) a retaining assembly movably connected to said frame and adapted to receive a block of cleaning material for removing accummulated material from the moving abrasive surface when in a contact position therewith;

(c) withdrawal means connected to and withdrawing said retaining assembly from said contact position;

(d) projection means connected to said frame and said retaining assembly, said projection means being adapted to apply a greater and opposite force on said retaining assembly than the force applied by said withdrawal means during the cleaning operation;

(e) control means associated with said projection means for selectively moving said retaining assembly and an associated cleaning block toward the moving abrasive surface and into said contact position therewith for cleaning thereof;

(f) said frame including a mounting tube positioned generally parallel to a roller associated with the abrasive apparatus;

(g) said withdrawal means including a fluid-actuated lifting cylinder mounted on said mounting tube and having a piston rod connected at an outer end thereof to said retaining assembly;

(h) said projection means including a fluid-actuated pressing cylinder mounted on said mounting tube and having a piston rod connected at an outer end thereof to said retainer assembly;

(i) air supply and regulator means for supplying pressurized air to said lifting cylinder and said pressing cylinder during operation thereof;

(j) said control means being adapted to actuate said pressing cylinder to force the cleaning block against the abrasive belt for a selected period of time;

(k) said control means including a programmable controller operatively connected to said lifting cylinder and said pressing cylinder and being programmable to vary the contact time of said cleaning block against the abrasive belt upon selection by the operator; and (l) said programmable controller being programmable to count a number of cleaning cycles of said cleaning block against the abrasive belt, calculate an estimated remaining weight of said cleaning block, and using the estimated weight, calculate new desired pressures in said lifting and pressing cylinders for varying the pressures accordingly.

11. (a) a frame adapted to be attached to an abrasive apparatus;

(b) a retaining assembly movable connected to said frame and adapted to receive a block of cleaning material for removing accummulated material from the moving abrasive surface when in a contact position therewith;

(c) withdrawal means connected to and withdrawing said retaining assembly from said contact position;

(d) projection means connected to said frame and said retaining assembly, said projection means being adapted to apply a greater and opposite force on said retaining assembly than the force applied by said withdrawal means during the cleaning operation;

(e) control means associated with said projection means for selectively moving asid retaining assembly and an associated cleaning block toward the moving abrasive surface and into said contact position therewith for cleaning thereof;

(f) said frame including a mounting tube positioned generally parallel to a roller associated with the abrasive apparatus;

(g) said withdrawal means including a fluid lifting cylinder mounted on said mounting tube and having a piston rod connected to an outer end thereof to said retaining assembly;

(h) said projection means including a fluid pressing cylinder mounted on said mounting tube and having a piston rod connected at an outer end thereof to said retainer assembly;

(i) air supply and regulator means for supplying pressurized air to said lifting cylinder and said pressing cylinder during operation thereof;

(j) said control means being adapted to actuate said pressing cylinder to force the cleaning block against the abrasive belt for a selected period of time;

(k) said control means including a programmable controller;

(l) said control means including a linear position measurement device operatively connected to said programmable controller;

(m) said programmable controller being operatively connected to said lifting and pressing cylinders to vary the pressures therein; said programmable controller being programmed to vary the contact time between said cleaning block and the abrasive belt in response to data presented thereto by the operator;

(n) said linear position measurement device being adapted to sense and record changes in displacement of said retaining assembly relative to said frame as the cleaning block wears away during a number of cycles of contact time; said linear position measurement device being connected to said programmable controller, whereby data representing the displacement of said cartridge assembly is communicated to said programmable controller; and (o) said programmable controller being programmed to receive the data representing the displacement of said cartridge assembly and to calculate a remaining weight of said cleaning block for varying the pressure in said lifting cylinder and said pressing cylinder in response thereto.

* * * * *